United States Patent [19]

Köhnen et al.

[11] Patent Number: 4,818,253

[45] Date of Patent: Apr. 4, 1989

[54] DEVICE FOR GASIFYING FINELY DIVIDED FUELS UNDER INCREASED PRESSURE

[75] Inventors: Klaus Köhnen, Mülheim/Ruhr; Hans Niermann; Norbert Ullrich, both of Essen, all of Fed. Rep. of Germany

[73] Assignee: Krupps Koppers GmbH, Essen, Fed. Rep. of Germany

[21] Appl. No.: 60,357

[22] Filed: Jun. 9, 1987

[30] Foreign Application Priority Data

Jul. 12, 1986 [DE] Fed. Rep. of Germany ..... 3623604

[51] Int. Cl.[4] ..... C01J 3/48; C01J 3/76

[52] U.S. Cl. ..... 48/67; 48/63; 48/69; 48/76; 122/7 R; 122/235 A

[58] Field of Search ..... 48/62, 63, 64, 67, 69, 48/DIG. 2, 76, 77, 73; 122/5, 6, 7 R, 6 A, 235 A, 235 B, 235 K, 367 R, 367 A, 512

[56] References Cited

U.S. PATENT DOCUMENTS

| | | | |
|---|---|---|---|
| 1,757,232 | 5/1930 | Becker | 122/5 |
| 1,810,738 | 6/1931 | Van Heeden | 48/63 |
| 1,897,950 | 2/1933 | Battin et al. | 122/5 |
| 2,823,103 | 2/1958 | Gruber | 48/63 |
| 4,272,255 | 6/1981 | Coates | 48/67 |
| 4,305,732 | 12/1981 | Koenig et al. | 48/67 |
| 4,343,626 | 8/1982 | Peise et al. | 122/5 |
| 4,707,163 | 11/1987 | Gudymov et al. | 48/73 |

FOREIGN PATENT DOCUMENTS

| | | | |
|---|---|---|---|
| 2425962 | 12/1975 | Fed. Rep. of Germany . | |
| 0237318 | 7/1986 | Fed. Rep. of Germany | 48/77 |

*Primary Examiner*—Peter Kratz

*Attorney, Agent, or Firm*—Michael J. Striker

[57] ABSTRACT

The gasification device includes a pipe wall structure assembled of a plurality of pipe circuits enclosing in a gas tight manner a reactor space. A pressure jacket surrounds at a distance the pipe wall structure and delimits therewith a water filled interspace. All inlet conduits for supplying cooling water to individual pipe circuits pass through the jacket whereas the outlets of the pipe circuits open into the interspace. A common discharge conduit for cooling water is provided in the pressure jacket and communicates with the interspace. The pressure jacket is assembled of two parts interconnected by a releasable flange connection. All inlet conduits and common outlet conduits are attached to the upper part so as to enable the lifting of the entire pipe wall structure upon the lower part together with the upper part.

5 Claims, 1 Drawing Sheet

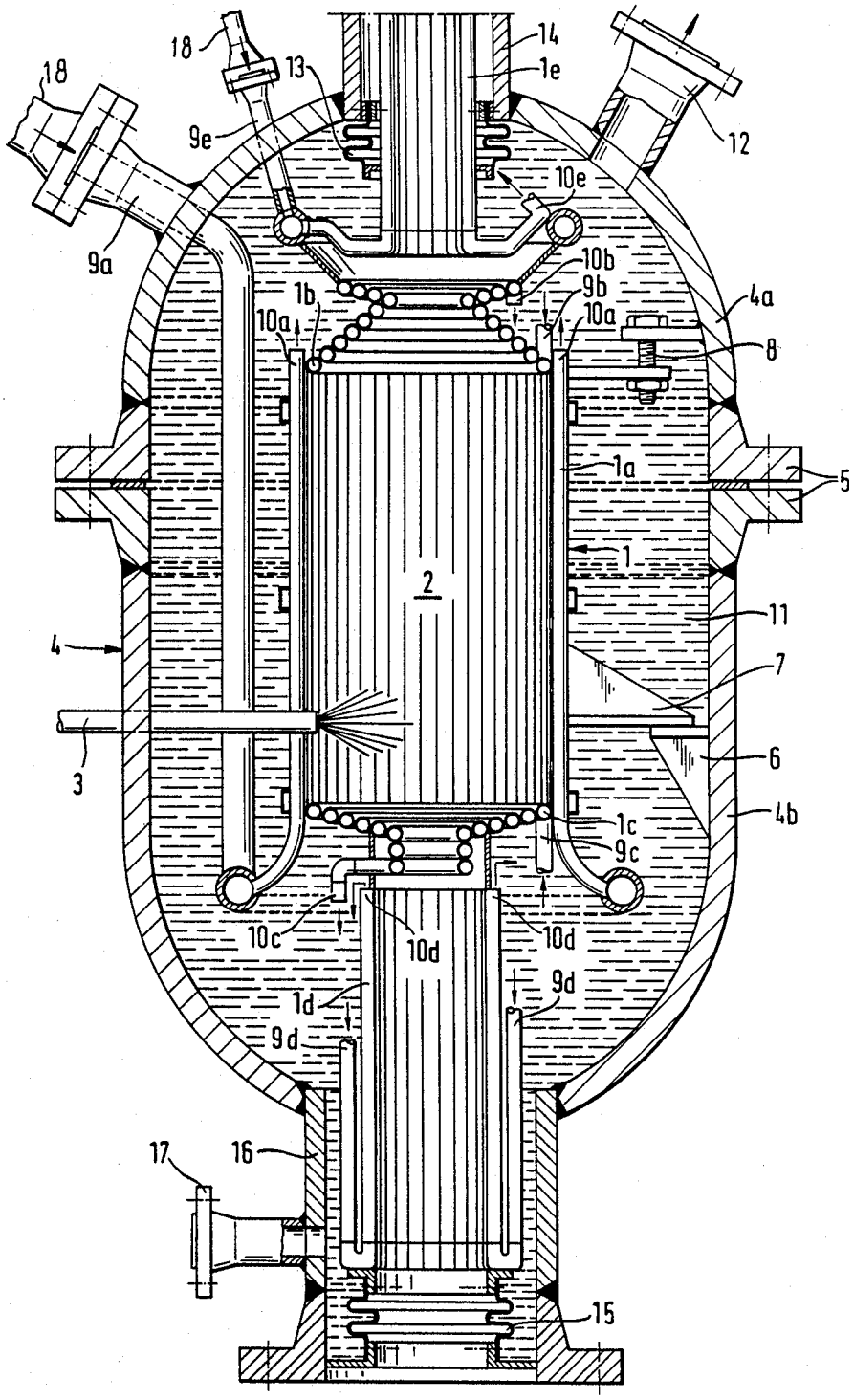
18
18
13
14
1e
12
9e
10e
9a
10b
9b
1b
10a
10a
4a
8
1a
5
1
2
11
4
7
3
6
4b
1c
9c
10c
10d
10d
9d
1d
9d
17
16
15

DEVICE FOR GASIFYING FINELY DIVIDED FUELS UNDER INCREASED PRESSURE

BACKGROUND OF THE INVENTION

The present invention relates in general to gasifiers of finely divided fuels, preferably solid fuels by means of oxygen containing gases applied under increased pressure whereby the gasification reactor is constructed as a pipe wall structure acted upon by cooling water and being surrounded at a distance by a pressure resistant jacket.

A device of this kind is known from DE-AS 24 25 962. In this known device, the pipe wall structure includes a plurality of cooling circuits whose inlets and outlets project through the pressure jacket. In addition, the interspace between the pipe wall structure and the pressure jacket is filled with an insulating material and a further inlet is formed in the jacket to supply into the interspace pressurized inert gas in order to prevent leakage of the product gas from the gasification reactor into the interspace where it might cause corrosion. Both measures require substantial investment and operation expenditures.

SUMMARY OF THE INVENTION

It is therefore an object of this invention to avoid the disadvantages of the prior art devices.

In particular, it is an object of this invention to provide such an improved gasifying device which is simple in structure, economic in manufacture and at the same improves the operational reliability.

In keeping with these objects and others which will become apparent hereafter, one feature of this invention resides, in hermetically sealing the interspace between the pipe wall structure and the pressure jacket so as to be gas tight and water tight, directing the outlets of the respective cooling circuits in the pipe face structure into the interspace while only the inlets of the cooling circuits pass through the pressure jacket, and providing the pressure jacket with a single outlet for the cooling water discharged from the cooling circuits and filling up during operation the whole interspace.

By virtue of the gas tight and water tight separation of the interspace of the wall pipe structure, namely of the gasification reactor, from the water-filled interspace between the wall pipe structure and the pressure jacket, the hot production gas from the gasification reactor is reliably and without any additional operational measures prevented from leaking into the interspace and contacting the pressure jacket. In this manner, the pressure jacket is protected against undesirable heat effects on the one hand and against corroding attacks of the production gas on the other hand. At the same time the water body filling the interspace around the pipe wall structure acts as an additional safeguard against an immediate action of hot gas on the pressure jacket in the event of an accidental breakage in the pipe wall structure.

A further advantage of the gasification device of this invention is the feature that only the inlet connection pieces to respective cooling circuits of the pipe wall structure and only a single common cooling water outlet pass through the pressure jacket while in contrast to conventional devices of this kind, the outlets of respective cooling circuits open into the interspace and do not pass through the pressure jacket.

According to another feature of this invention the respective cooling circuits of the pipe wall structure are connected with means for a forced circulation of cooling water. In this manner apart from guaranteeing a reliable cooling at all points of the pipe wall structure, the forced circulation enables an arbitrary guiding of the pipes and pipe reversal in the cooling water circuits.

The water filled interspace between the pipe wall structure and the pressure jacket is preferably exposed to a slightly higher pressure than that of the production gas in the inner reactor space of the pipe wall structure. This measure guarantees an additional safeguard against the leakage of the production has from the gasification reactor toward the pressure jacket in the case of a breakage.

According to a further advantageous feature of this invention, the pressure jacket is assembled of two parts provided with a connecting flange. All inlet conduits for respective cooling circuits of the pipe wall structure as well as the common outlet for the cooling water pass through and are connected with the upper part of the jacket so that the entire pipe wall structure is supported by the upper part and can be lifted as a whole from the lower part. Consequently, repair and maintenance work on the pipe wall structure or in the interior of the pressure jacket is considerably facilitated.

Furthermore, in the preferred embodiment the top end and the bottom end of the pipe wall structure are connected to the pressure jacket by means of expansion compensators in order to neutralize any heat expansion of the pipes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE illustrates schematically an axial section of an embodiment of the gasification device of this invention.

DESCRIPTION OF THE PREFERRED EMBODIMENT

In the FIGURE, reference numeral 1 indicates a pipe wall structure whose inner space 2 serves as a gasification reactor. A plurality of burners 3 of which only one is illustrated eject laterally into the reactor space 2.

The pipe wall structure 1 is surrounded at a distance by a two-piece pressure jacket 4 whose upper part 4*a* is secured through its lower part 4*b* by a flange connection 5. The inner wall of the lower part 4*b* of the pressure jacket is provided with a plurality of bearing brackets 6 for supporting consoles 7 projecting from the pipe wall structure 1 and supporting the same in a centered position. The pipe wall structure 1 is suspended on the upper part 4*a* of the jacket by means of suspension elements 8 which permit thermal expansion of the pipe wall structure in axial direction relative to the pressure jacket.

The pipe wall structure is assembled of individual cooling circuits 1*a*, 1*b*, 1*c*, 1*d* and 1*e*. Each of the cooling circuits has a separate inlet conduit 9*a* through 9*e* connected via connection piece 18 to a non-illustrated means for a forced circulation of cooling water. The inlet conduits 9b and 9d pass through the upper part 4a of the pressure jacket in the same manner as the illustrated inlet conduits and 9e. It will be seen from the drawing that outlets 10a through 10e of respective cooling circuits open in the water filled interspace 11 between the pipe wall structure 1 and the pressure jacket 4. The interspace 11 has a single cooling water outlet 12 common to all cooling circuits. The water outlet 12 passes through the upper part 4a of the pressure jacket and communicates with a non-illustrated steam cylinder. As mentioned before, pressure in the interspace 11 is preferably set slightly higher than the pressure of production gas in the reactor space 2. However the pressure difference in spaces 2 and 11 should not be too high in order to prevent overloading of the pipe wall structure. Pressure in the gasification reactbr2 which xy amount for example to 40 Bar, is thus taken up by the pressure resistant jacket 4 via the 1ater body present at -a slightly higher pressure in the interspace 11. Accordingly, the pipe wall structure 1 itself is thus loaded by the minute pressure difference only.

Since in the gasification device of this invention the individual pipes of the pipe wall structure are exposed to substantially equal pressures acting on the inside and outside, they may be designed with a relatively small wall thickness. As a consequence, during the operation the temperature difference in the pipe wall is minute and accordingly temperature stresses in the pipe wall are advantageously reduced and the parts of the pipe exposed to the hot product gas can withstand higher temperatures.

Reference numeral 13 denotes an expansion compensator which at one end is attached to the upper part 1e of the pipe wall structure and at the other end is attached to the upper part 4a of the pressure jacket in the range of the gas outlet 14. Another compensator 15 connects the bottom end 1b of the pipe wall structure with the sludge discharge tube 16 formed on the bottom of the lower part 4b of the pressure jacket. By means of the compensators 14 and 15 diferent heat expansions of the pipe wall structure and pressure jacket are neutralized. In the range of the lower end of the sludge discharge flute 6 there is provided also a discharge connection piece 17 for removing water from the interspaces 11.

Since all inlet conduits 9a through 9e for cooling water and the common outlet conduit 12 for the cooling water project through the upper part 4a of the pressure jacket, it is made possible after loosening the flange connection 5 and disconnecting the lower compensators 15 to lift the upper part 4a of the jacket together with the suspended complete pipe wall structure 1 from he lower part 4b of the jacket. In this manner the pipe wall structure is freely accessible for any repair and maintenance work. As a result, the prior art measures and space demanding devices for accessing the interspace 11 can be dispensed with.

While the invention has been illustrated and described as embodied in a specific example of a gasification device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for gasification of finely divided fuels by oxygen containing gases under increased pressure, comprising a pipe wall structure assembled of a plurality of pipe circuits for cooling water which enclose 5 a gasification reactor space; a pressure jacket surrounding at a distance the pipe wall structure to delimit therewith an inter7 space; each of said pipe circuits having an inlet conduit passing through said pressure jacket and an outlet end opening into said interspace to fill the same with a body of water; a common water discharge conduit provided in said pressure jacket and communicating with said interspace; and means for hermatically separating said gasification reactor space from said interspace.

2. A device as defined in claim 1, further comprising means for a forced circulation of cooling water in respective pipe circuits of the pipe wall structure.

3. A device as defined in claim 2, wherein said means for a forced circulation are set for keeping the water filled interspace between the pipe wall structure and the pressure jacket under a slightly increased pressure with respect to the gas pressure in the gasification reactor space.

4. A device as defined in claim 1, wherein said pressure jacket is assembled of an upper part and a lower part releasably interconnected by a flange connection; said inlet conduits of respective circuits of the pipe wall structure and the common discharge conduit for water being provided in said upper part of the jacket to enable upon releasing the flange connection to lift the upper part together with the whole pipe wall structure away from the lower part.

5. A device as defined in claim 1, wherein said hermetically separating means includes expansion compensators connecting the upper and lower ends of said pipe wall structure with corresponding ends of said pressure jacket to neutralize temperature expansions in the pipe wall structure.

* * * * *